United States Patent [19]

Latiolais et al.

[11] 4,124,253

[45] Nov. 7, 1978

[54] SULFUR WELL SEALING METHOD

[75] Inventors: Rene L. Latiolais; Walter W. Hranitzky, both of New Orleans, La.

[73] Assignee: Freeport Minerals Company, New York, N.Y.

[21] Appl. No.: 862,779

[22] Filed: Dec. 21, 1977

[51] Int. Cl.[2] ..... E21B 43/28; E21C 41/14

[52] U.S. Cl. ..... 299/6; 166/314

[58] Field of Search ..... 299/4–6; 166/305 R, 314

[56] References Cited

U.S. PATENT DOCUMENTS

| | | | |
|---|---|---|---|
| 800,127 | 9/1905 | Frasch | 299/6 |
| 2,749,991 | 6/1956 | Spearow | 166/305 R |
| 3,630,573 | 12/1971 | Goddin et al. | 299/6 |

*Primary Examiner*—Ernest R. Purser

*Attorney, Agent, or Firm*—Fisher, Christen & Sabol

[57] ABSTRACT

A method is disclosed for sealing a sulfur well wherein the well is made to discharge only sulfur and air instead of mixtures of sulfur, water and air. The method is used in conjunction with the Frasch mining technique when starting a new well for the first time and when an active well has "blown". The method consists of shutting off the sulfur line and air line, "boosting" the well by sending down hot "superheated water" through the water line to raise the level of the sulfur pool by melting additional sulfur, slowly applying a pressurized gas to the top of the sulfur line and holding at an elevated pressure for a period of time and then slowly releasing the pressurized gas. The air line is then opened and pressurized, and a mixture of sulfur and air, devoid of water, exits through the sulfur line.

9 Claims, 5 Drawing Figures

SULFUR WELL SEALING METHOD

FIELD OF THE INVENTION

This invention relates to sulfur mining and, specifically, to a method for sealing a sulfur well.

BRIEF DESCRIPTION OF THE PRIOR ART

Many techniques have been used in the United States to mine sulfur since the discovery of sulfur deposits in the late 1800's. The most commercially successful of these has been the Frasch process, perfected by Herman Frasch around the turn of the century. Briefly, this process involves sinking a pair of concentric pipes into the sulfur deposit and sending hot "superheated water" down through both pipes to initially heat up the formation and melt the sulfur deposit. As used throughout the Frasch sulfur mining industry, and as used in this detailed description, the term "superheated water" means water that has been heated under pressure to a temperature higher than the normal melting point of sulfur, i.e., higher than about 250° F. After the initial melting, the hot water is cut off from the inner pipe but allowed to continue through the outer pipe so as to exit in the upper portion of the sulfur deposit. The molten sulfur is raised about halfway up the inner pipe due to the formation pressure. Compressed air is introduced into the upper portion of the inner pipe by a third concentric pipe to produce a mixture of liquid sulfur and air that is of such a density that it can be raised to the surface by the formation pressure.

In the Frasch mining industry the term "sealing of a well" is defined as the operation whereby a sulfur well is made to discharge essentially only sulfur and air, and not a mixture of water, air and sulfur as it often happens when a well is first started. When water is found in the sulfur line its presence may be due to the lowering of the molten sulfur pool below the sulfur inlet, which allows the superheated water to enter the sulfur line. When the water exits the well at the surface it flashes (due to its being superheated) causing heat losses and disrupting the operation of the well.

Previous sulfur well sealing techniques were complicated, time consuming, and often unsuccessful. They normally involved the steps of shutting off the sulfur and air lines; "boosting" the well by sending down hot, superheated water to melt more sulfur and raise the level of the molten sulfur pool (an operation which may take several hours); shutting off the water being sent down through the sulfur line when the level of the molten sulfur rises past the sulfur inlet, although this point is difficult, if not impossible to determine accurately; and opening the sulfur line and the air line to allow the sulfur to come up to the surface. Unfortunately, this also allows all of the water in the line to exit along with the sulfur. The effluent in the last step must be disposed of and, for a short time afterward, the sulfur-and-air mixture flows out of the well mixed with traces of water.

U.S. Pat. No. 3,620,571 to Billings discloses a sulfur mining process wherein a hot combustion gas is substituted for the heated water in the typical Frasch mining technique. Billings does not teach the application of a pressurized gas to the sulfur line to force out the water.

Similarly, U.S. Pat. No. 1,308,929 to Carmichael is likewise devoid of any such teaching. This reference teaches the use of a movable concentric pipe which directs the hot water to various exit points within the well.

SUMMARY OF THE INVENTION

The present invention involves a method of sealing a sulfur well of the Frasch-process type. As already stated, the sealing of a well is defined as making the well discharge essentially only sulfur and air at the sulfur exit instead of a mixture of sulfur, water and air. A well will produce this latter mixture during its initial start up as well as when, after being active, the well has "blown", i.e., when the molten sulfur pool is lowered to the point where water and air, along with some sulfur, are discharged through the sulfur exit pipe. In practicing the invention, the sulfur and air lines are first shut off; the well is then "boosted" by sending hot superheated water through the water line to bring up the level of the molten sulfur pool; the water is then shut off; thereafter, a pressurized gas (such as air or nitrogen) is applied to the top of the sulfur line; after a predetermined holding time, the pressurized gas is released; and, finally, the air line is opened, and only sulfur and air, devoid of water, come out the sulfur line.

The application of the pressurized gas to the top of the sulfur line apparently forces all of the water in the sulfur line downwardly, back into the mine formation, and the water, being lighter than the sulfur, rises to the surface of the sulfur pool, thereby allowing the sulfur to come out uncontaminated.

DETAILED DESCRIPTION OF THE PREFERRED EMBODIMENT

Figure 1:
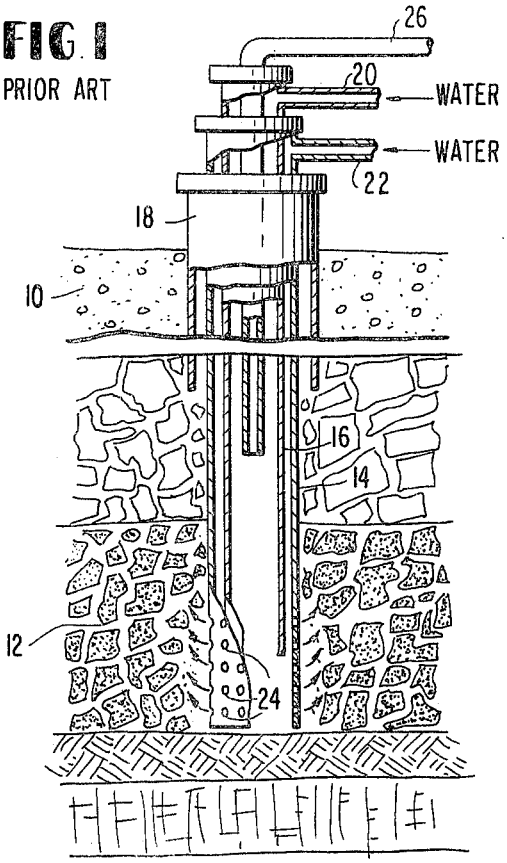
FIG. 1 PRIOR ART
FIG. 1 shows the Frasch-process sulfur well during the initial start-up.

Before a detailed description of the invention can be given, it will be necessary to describe the apparatus and method used in a typical Frasch-process well. A hole is drilled down through the formation and through cap rock 10 and into sulfur deposit 12. Into this hole is inserted pipe 14 having pipe 16 concentrically arranged inside. Pipe 14 extends to the bottom of sulfur deposit 12, while pipe 16 stops a short distance above the bottom. Both pipes extend upwardly through protective casing 18. Pipe 16 communicates with sulfur line 20 while pipe 14 communicates with water line 22. Pipe 14 has several rows of openings 24 near its lower end communicating with the formation and the annular space between pipes 14 and 16, while the remaining openings communicate with the formation and the interior of pipe 16. Air line 26 extends into pipe 16 and reaches downwardly approximately one-half the well depth.

To initiate operation of the well, water heated under pressure to about 325° F. is pumped into the water line 22 and the sulfur line 20 and down to the sulfur deposit 12 by pipes 14 and 16. As seen in FIG. 1, the water exits via the openings in the lower portion of pipe 14 and, since its temperature is higher than the melting point of sulfur (246° F.), causes the sulfur in sulfur deposit 12 to melt.

Figure 2:
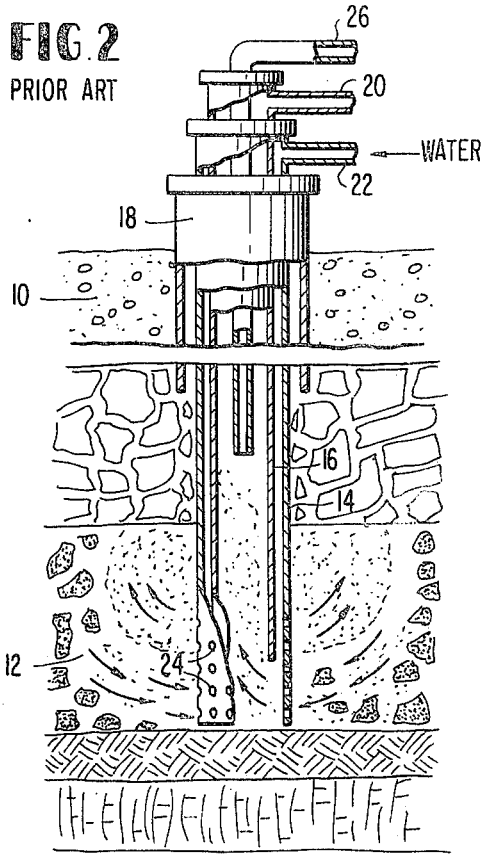
FIG. 2 PRIOR ART
FIG. 2 shows the sulfur well of FIG. 1 during the second stage of the start-up.
Figure 3:
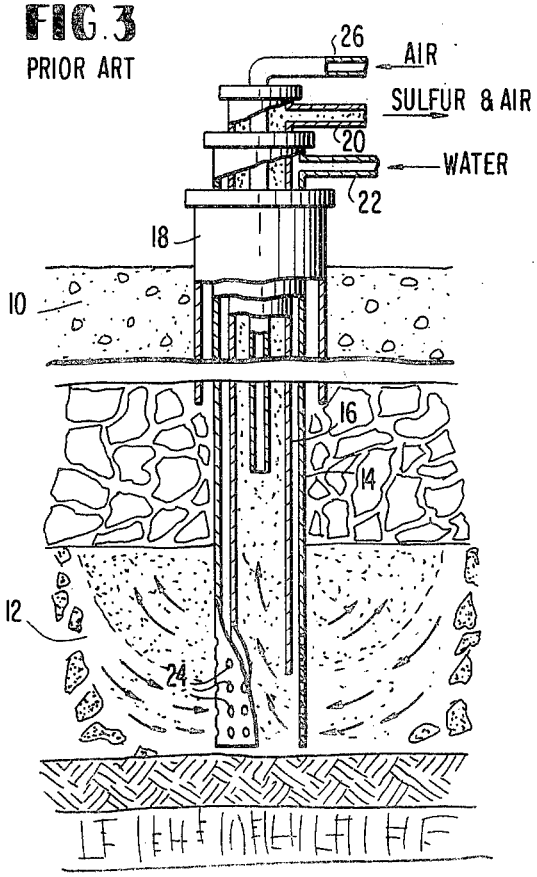
FIG. 3 PRIOR ART
FIG. 3 shows the sulfur well of FIG. 1 in its production mode.

Once sufficient sulfur in sulfur deposit 12 has melted and formed a pool near the bottom of pipe 14, the hot, superheated water is cut off from sulfur line 20 and, consequently, pipe 16. Water continues to pass into sulfur deposit 12 via water line 22 and the annular space between pipes 14 and 16, as shown in FIG. 2, to assure a continuous supply of molten sulfur. The static pressure of the water forced into the formation forces the liquid sulfur upwardly through pipe 16. As the sulfur level inside pipe 16 rises, compressed air is introduced into the sulfur via line 26. This serves to reduce the density so that the sulfur-air mixture will rise all the way to the surface and exit through line 20, as shown in FIG. 3.

The foregoing describes a Frasch-process sulfur mine operating under ideal conditions. As a practical matter, however, when a well is operated initially, or when an operating well has "blown", i.e., when the level of molten sulfur drops such that the superheated water enters pipe 16, the well produces a mixture of sulfur, air and water in sulfur line 20 instead of the more desirable air and sulfur mixture. The water, being superheated, flashes at the surface causing heat losses and generally disrupting the operation of the well, often making it necessary to stop production. In addition, the water effluent exiting the sulfur line is laden with sulfur and sulfur-containing gases, such as hydrogen sulfide and the like, and consequently presents a disposal problem, since effluents of this kind may not be discharged as they are without contaminating the environment. Costly decontamination and other pre-discharge treatment techniques then become necessary for the operation of the well.

Figure 4:
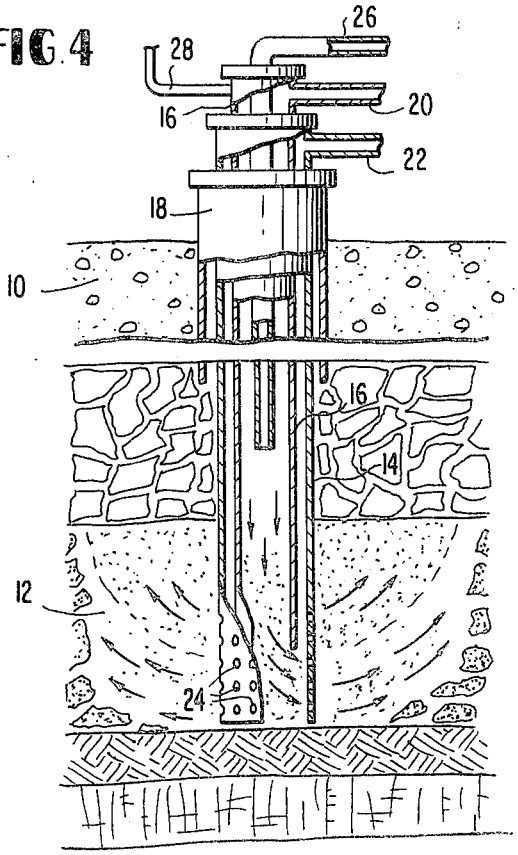
FIG. 4 shows a Frasch process sulfur well according to the invention.

Obviously, it would be desirable to have a method for effectively eliminating this water from the pipe 16 while minimizing down-time and preventing disruption in well production, while at the same time eliminating or substantially decreasing the need for expensive decontamination and other pre-discharge treatment techniques. The present invention provides one such method. In accordance with the present invention, once the presence of water is discovered in sulfur line 20, this line is shut off, along with air line 26. Hot, superheated water is then send down to the sulfur deposit 12 via water line 22 and, optionally, also via sulfur line 20 to melt more sulfur and raise the level of the molten sulfur pool. After a period of time sufficient to raise the level of the molten sulfur pool, high-pressure air is supplied to the top of sulfur pipe 16 by high-pressure air line 28, as shown in FIG. 4. Although the invention will be described using high pressure air, it will be understood that other pressurized gases (such as nitrogen) and pressurized mixtures of gases may also be used. The pressurized air is applied at a pressure greater than the back pressure created by the water in the sulfur line. The exact pressure necessary to seal a well in accordance with the method of this invention will vary depending on such factors as the depth of the well, the type of compressed gas used to pressurize, the density of the water within the caprock and the localized imposed mine pressure. Normally, the pressure applied will be between about 450 and 1600 psig and, preferably, between about 600 and 1150 psig. The pressurized air forces the water downwardly and back into the sulfur formation. Apparently, since the water is less dense than the molten sulfur, it rises to the top of the molten sulfur pool and away from the end of pipe 16. The application of the pressurized air, that is, the pressurization of the lines, may take from 20 to 30 minutes, depending on the depth of the well. After the desired pressure is reached, this pressure should then be maintained for about 15–60 minutes, and preferably for about 20 miutes, to force the water out of pipe 16. This time will also vary according to the well depth.

After a sufficient time, the pressurized air is released to return pipe 16 to its normal pressure, that is, atmospheric pressure. Air line 26 is opened to supply air to the sulfur in pipe 16 and sulfur line 20 is opened to allow the water-free sulfur-air mixture to exit the well.

The method according to the invention was tested in a sulfur well 1,848 ft. deep using a combination of air and nitrogen at a pressure of 785 psig. Superheated water was pumped into the formation at a rate of 100 GPM. The pressurized gas was held at 785 psig for 20 minutes and then slowly released. After 21 minutes the pressure was down to zero. Air was then supplied to the sulfur in the well at 35 CFM for six minutes, after which a molten sulfur-air mixture totally devoid of any water was exiting from the well. Several other trials were conducted using only air, pressurized at 780 psig, with similarly successful results.

Figure 5:
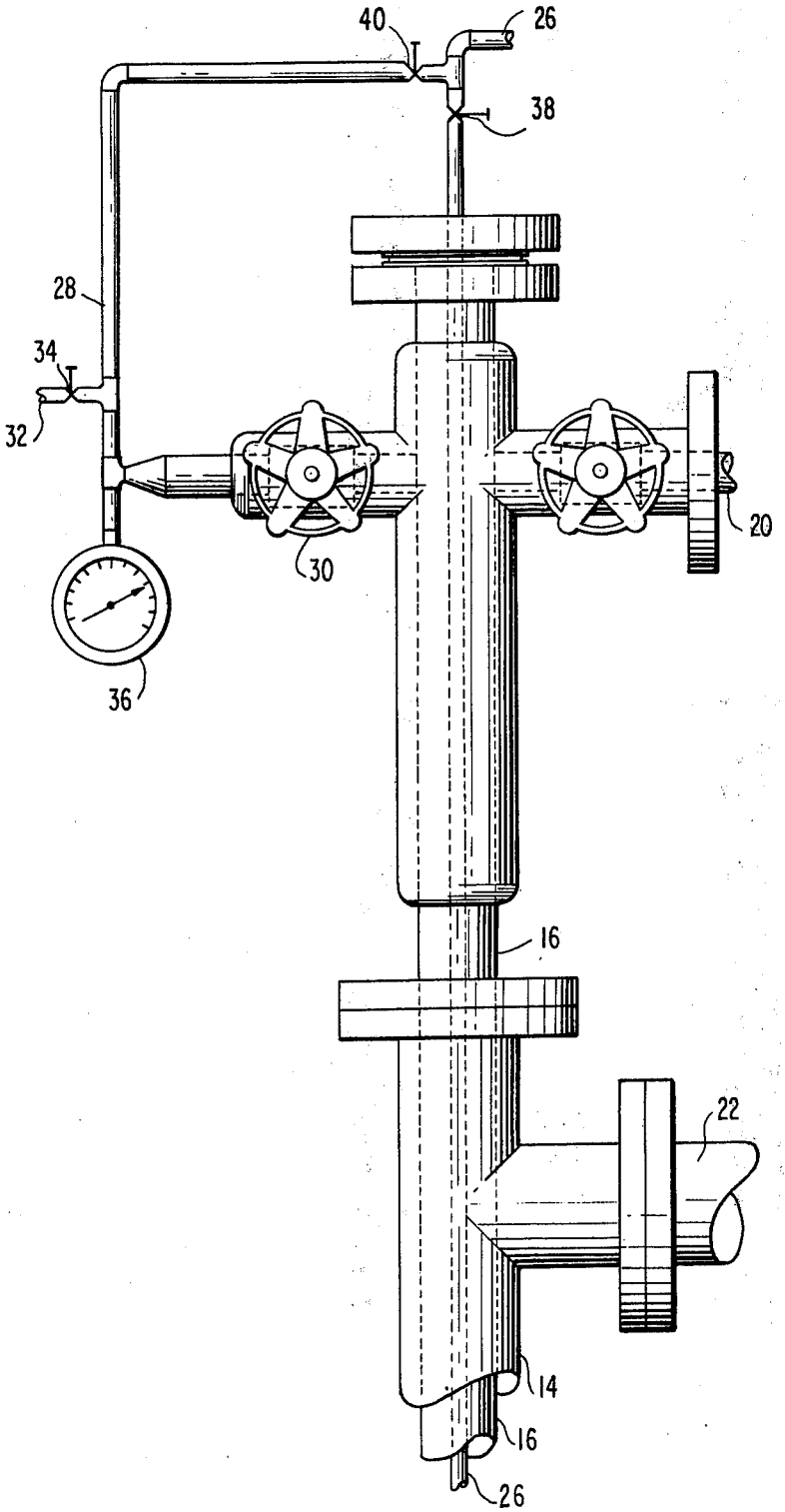
FIG. 5 shows an apparatus for carrying out the method of the invention.

The apparatus for carrying out the method of the invention is shown in detail in FIG. 5. Line 28 may connect air line 26 with the top of sulfur pipe 16 through valve 30. To carry out the method of the invention, valve 38 is closed and valve 40 is opened to direct the pressurized air into line 28. Valve 30 is opened to direct the pressurized gas into the top of pipe 16. Additional pressurized air or nitrogen may be supplied via line 32 through valve 34. Pressure gage 36 gives a visual readout of the pressure in line 28. It is understood that any other similar apparatus may be used to carry out the method of this invention.

What is claimed is:

1. A method of sealing a sulfur well comprising the steps of:

(a) applying a pressurized gas to the top of a sulfur flow pipe at a pressure sufficiently high to force water in the flow pipe back into the sulfur formation;

(b) holding said pressure for a predetermined amount of time; and (c) slowly releasing said pressure gas to allow the sulfur flow pipe to return to its normal operating pressure.

2. The method of claim 1 wherein said pressurized gas is compressed air.

3. The method of claim 1 wherein said pressurized gas is nitrogen.

4. The method of claim 1 comprising the further steps of melting at least a portion of the sulfur in the sulfur formation before releasing the pressurized gas.

5. In a Frasch-process sulfur well having a sulfur discharge pipe extending from the gound surface into an underground sulfur formation, the improved method of preventing the contamination of sulfur in said discharge pipe comprising:

(a) applying a pressurized gas to the uppermost portion of said discharge pipe so as to force the water in said discharge pipe back into the underground sulfur formation;

(b) holding the pressurized gas at a predetermined pressure for a predetermined time;

(c) melting sulfur in the underground sulfur formation such that the level of the molten sulfur is above the end of the sulfur discharge pipe; and, (d) slowly releasing the pressurized gas to allow the sulfur discharge pipe to return to its normal operating pressure.

6. The method of claim 5 wherein said pressurized gas is air.

7. The method of claim 5 wherein said pressurized gas is nitrogen.

8. The method of claim 5 wherein said melting of sulfur in the underground sulfur formation is achieved by contacting the sulfur with superheated water at a temperature higher than the normal melting point of sulfur.

9. The method of claim 5 wherein the pressurized gas is held at its predetermined pressure in the sulfur discharge line for a period of time between 15 and 60 minutes.

* * * * *